United States Patent [19]

Schumacher

[11] Patent Number: 4,827,948

[45] Date of Patent: May 9, 1989

[54] APPARATUS FOR CHANGING THE DIRECTION OF TRANSPORT OF ROD-SHAPED ARTICLES OF THE TOBACCO PROCESSING INDUSTRY

[75] Inventor: Peter Schumacher, Hamburg, Fed. Rep. of Germany

[73] Assignee: Körber AG, Hamburg, Fed. Rep. of Germany

[21] Appl. No.: 127,243

[22] Filed: Dec. 1, 1987

[30] Foreign Application Priority Data

Dec. 1, 1986 [DE] Fed. Rep. of Germany ..... 3641064

[51] Int. Cl.[4] ..... A24C 5/32; A24C 5/33; A24C 5/35

[52] U.S. Cl. ..... 131/282; 131/94; 131/280; 198/471.1; 198/418

[58] Field of Search ..... 131/94, 280, 281, 282, 131/283; 198/420, 471.1

*Primary Examiner*—V. Millin
*Attorney, Agent, or Firm*—Peter K. Kontler

[57] ABSTRACT

Apparatus for changing the direction of transport of cigarettes and analogous rod-shaped articles of the tobacco processing industry has a horizontal guide rail which guides parallel first and second moving files of coaxial articles into the range of a first conveyor having a series of arms which orbit about a fixed axis and simultaneously rotate about discrete axes. Each arm has first and second flute-like conveying elements each serving to remove a discrete article from the respective file and to hold the received article against a change of orientation during orbital movement toward a transfer station where the articles are transferred from the first and second conveying elements of successive arms into the peripheral flutes of first and second rotary drum-shaped conveyors serve to transport two rows of articles at right angles to the axes of the articles. The rotary conveyors deliver articles into the flutes of an additional rotary drum-shaped conveyor which transports two rows of parallel articles sideways into or in a filter tipping or other processing machine. The conveying elements of the arms transport pairs of articles which are staggered axially relative to each other, and the first and second rotary conveyors are driven to rotate about parallel axes located in a plane in which the peripheral flutes receive articles from the conveying elements.

26 Claims, 4 Drawing Sheets

26
29
29
2b
2a
4
B
B
27
13b
13a
12b
12a
b
16
7b
7a
6
a
27
14b
14a
27
27
7b
7a
6
3
2a
2b

APPARATUS FOR CHANGING THE DIRECTION OF TRANSPORT OF ROD-SHAPED ARTICLES OF THE TOBACCO PROCESSING INDUSTRY

CROSS-REFERENCE TO RELATED CASE

The apparatus of the present invention is somewhat similar to that which is disclosed in the commonly owned copending patent application Ser. No. 07/111,402 filed Oct. 20, 1987, by Hensgen et al. for "Apparatus for transporting groups of rod-shaped articles of the tobacco processing industry".

BACKGROUND OF THE INVENTION

The invention relates to apparatus for transporting rod-shaped articles of the tobacco processing industry, and more particularly to improvements in apparatus for changing the direction of transport of rod shaped articles, such as filter rod sections and plain or filter cigarettes, cigars, cigarillos and cheroots. Still more particularly, the invention relates to improvements in apparatus for simultaneously converting several files of coaxial rod-shaped articles into several rows of parallel articles.

It is already known to construct a cigarette maker in such a way that it can simultaneously turn out several continuous cigarette rods which are subdivided into sections of desired length and are thereupon treated in packing, filter tipping and other processing machines. The situation is analogous in connection with the treatment of cigars and cigarillos. For the sake of simplicity, the following part of this description will refer primarily to cigarettes or filter cigarettes with the understanding, however, that the same apparatus can be used with equal or similar advantage for the manipulation of other types of rod-shaped articles of the tobacco processing industry including plain or filter tipped cigarillos, cigars, cheroots and filter rod sections. A machine which can turn out two parallel cigarette rods is disclosed, for example, in U.S. Pat. No. 1,705,012 to W. F. Grupe.

As a rule, cigarettes which are obtained by severing one or more cigarette rods are conveyed in the form of elongated files of coaxial articles. It is often necessary to change the direction of such articles, for example, in a filter tipping machine which is designed to convert plain cigarettes and filter rod sections into filter cigarettes of unit length or multiple unit length. A modern filter tipping machine is designed to place discrete filter mouthpieces of double unit length between pairs of plain cigarettes of unit length, to convolute uniting bands around the mouthpieces and around the adjacent end portions of the respective plain cigarettes, and to sever the resulting filter cigarettes of double unit length across the mouthpieces and the tubular wrappers which are obtained by conversion of uniting bands so that each filter cigarette of double unit length yields two coaxial filter cigarettes of unit length. To this end, it is necessary to change the direction of transport of plain cigarettes from axial movement to transverse or sidewise movement not later than in the filter tipping machine.

The aforementioned commonly owned copending patent application of Hensgen et al. discloses a transporting apparatus which can be utilized to change the direction of transport of plain cigarettes and similar rod-shaped articles of the tobacco processing industry from axial to transverse. The present invention relates to apparatus which are similar to and can perform the same functions as the apparatus of Hensgen et al.

OBJECTS AND SUMMARY OF THE INVENTION

An object of the invention is to provide a novel and improved apparatus which can reliably change the direction of transport of rod-shaped articles of the tobacco processing industry in a small area and at a high speed.

Another object of the invention is to provide an apparatus which can change the direction of transport of rod-shaped articles from axial movement to transverse or sidewise movement at the rate of discharge of articles from a machine which turns out several files of coaxial rod-shaped articles.

A further object of the invention is to provide a novel and improved method of manipulating cigarettes and analogous rod-shaped articles of the tobacco processing industry between a maker which turns out several continuous rods and one or more processing machines which must receive discrete articles in such a way that the articles travel sideways, namely at right angles to their respective axes.

Still another object of the invention is to provide the apparatus with novel and improved conveyor means for manipulating rod-shaped articles which are supplied in the form of several parallel files of coaxial articles.

Another object of the invention is to provide the apparatus with novel and improved conveyor means for accepting rod-shaped articles from several files of coaxial rod-shaped articles.

An additional object of the invention is to provide the apparatus with novel and improved means for transmitting torque to rotary conveyors.

A further object of the invention is to provide an apparatus which treats the articles gently, which can change the direction of transport of large numbers of articles per unit of time, and which can constitute a direct link between a maker of several discrete cigarette rods and one or more filter tipping or other processing machines wherein rod-shaped articles must travel at right angles to their respective axes.

The invention resides in the provision of an apparatus for transporting rod-shaped articles of the tobacco processing industry. The apparatus comprises means for supplying a plurality of parallel files of rod-shaped articles wherein the articles of each file are coaxial with each other and move axially, first conveyor means having a plurality of arms or analogous means for simultaneously removing groups of articles from the supplying means, one article from each file, and for moving the articles of the group substantially axially along a predetermined path, and second conveyor means having a plurality of means for simultaneously accepting groups of articles from successive removing means of the first conveyor means and for moving the articles of the accepted groups substantially at right angles to the axes of the respective articles. In accordance with a presently preferred embodiment, the supplying means includes means for supplying two files of articles so that each group consists of two articles.

The supplying means can include means for maintaining the articles of the two files in a common plane, preferably in a substantially horizontal plane.

The first conveyor means preferably comprises means for circulating the removing means along an endless path, and each of the removing means preferably comprises two article conveying elements. The mutual positions of conveying elements of each of the removing means preferably correspond to those of the two files of articles in the supplying means. The conveying elements of each of the removing means are preferably parallel to each other and are preferably spaced apart from each other by a distance corresponding to the mutual spacing of the two files of articles which are supplied by the supplying means. The article conveying elements of each removing means are preferably staggered relative to each other in the axial direction of the articles therein. The extent of staggering is preferably such that the articles which are conveyed by the conveying elements of a removing means are staggered by the length of an article. The first conveyor means preferably further comprises means for maintaining the removing means in a single predetermined orientation so that the articles are invariably ready for transfer onto the second conveyor means during each and every stage of transport by the conveying elements of the removing means of the first conveyor means.

The second conveyor means preferably comprises two endless rotary conveyors (such as drums) each having an annulus of article transporting members. The article transporting members are preferably axially parallel flutes which are provided in the peripheral surfaces of the rotary conveyors. The rotary conveyors preferably have parallel axes of rotation. The annuli of transporting members preferably have identical diameters, and the mutual spacing of neighboring transporting members of each of the two annuli is preferably the same.

The distance between the axes of the rotary conveyors preferably equals or closely approximates the distance of the conveying elements of each removing means of the first conveyor means from one another. The parallel axes of rotation are disposed in a predetermined plane (preferably in a horizontal plane), and the removing means are preferably arranged to deliver pairs of rod-shaped articles to the transporting members of the rotary conveyors in such predetermined plane.

The second conveyor means further comprises means for rotating the rotary conveyors about their respective parallel axes in synchronism with each other. The rotating means preferably includes a drive for one of the rotary conveyors, and the second conveyor means can further comprise means for transmitting torque from the one rotary conveyor to the other rotary conveyor of the second conveyor means. Such torque transmitting means can comprise at least one linkage. The arrangement is preferably such that the removing means of the first conveyor means are circulated along an endless path about a predetermined axis extending at right angles to the parallel axes of the rotary conveyors of the second conveyor means.

The transporting members of the second conveyor means preferably include means for effecting or facilitating axial movements of the articles therein so as to avoid collision of articles which are transported by the transporting members of one of the annuli with articles which are transported by the transporting members of the other annulus.

The apparatus preferably further comprises additional conveyor means having means for accepting articles from the transporting members of the rotary conveyors of the second conveyor means. Such accepting means preferably includes flutes each having a length such that it can receive an article from each of the two rotary conveyors. The transporting members of the rotary conveyors are preferably arranged to substantially simultaneously deliver discrete articles into consecutive flutes of the additional conveyor means. Each flute is preferably arranged to receive first an article from a transporting member of one of the rotary conveyors and thereupon an article from a transporting member of the other rotary conveyor of the second conveyor means. The second and additional conveyor means include means for moving the transporting members and the accepting means in synchronism so that the additional conveyor means receives and conveys two rows of parallel articles which move at right angles to their respective axes.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
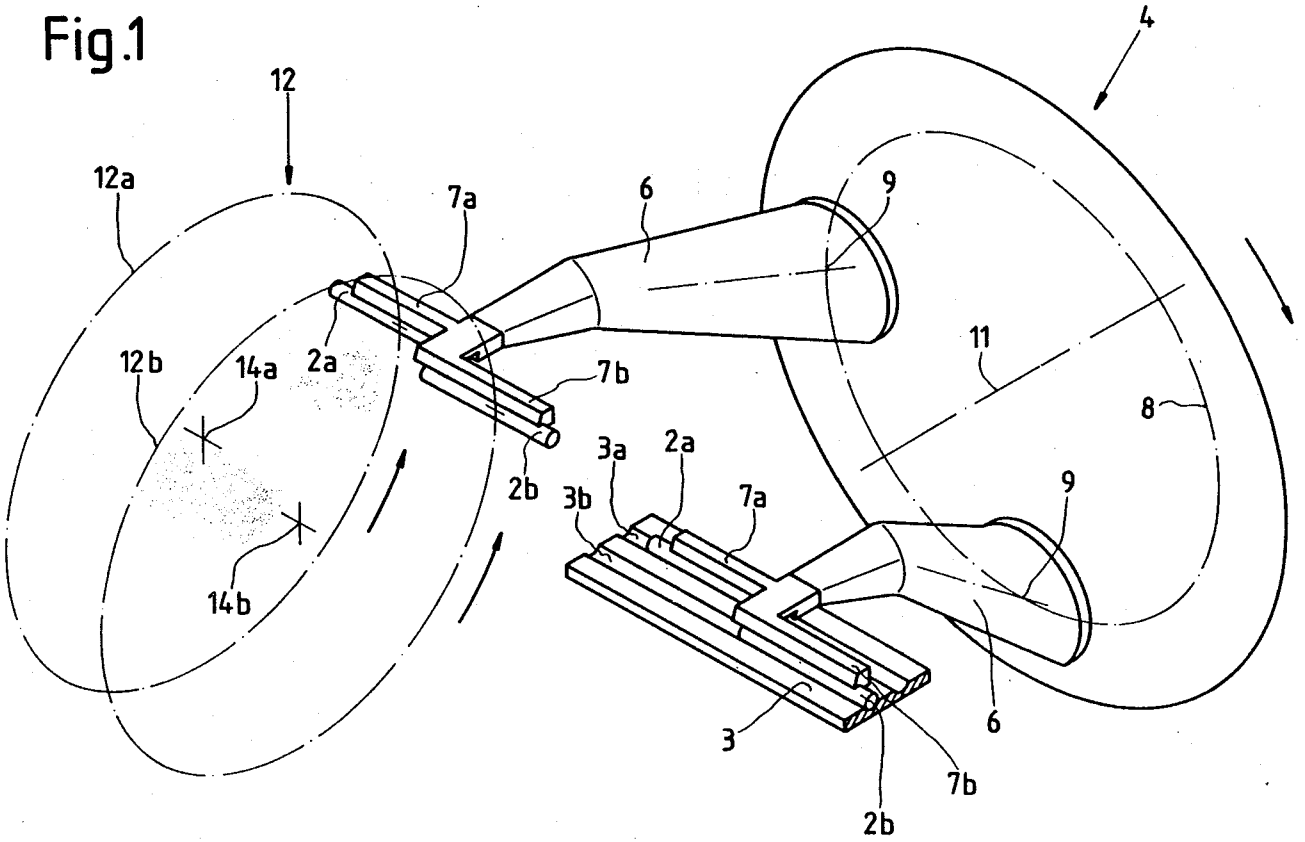
FIG. 1 is a perspective view of an apparatus which embodies the invention, the rotary drum-shaped conveyors of the second conveyor means being indicated by phantom-line circles and the additional conveyor means being omitted.
Figure 2:
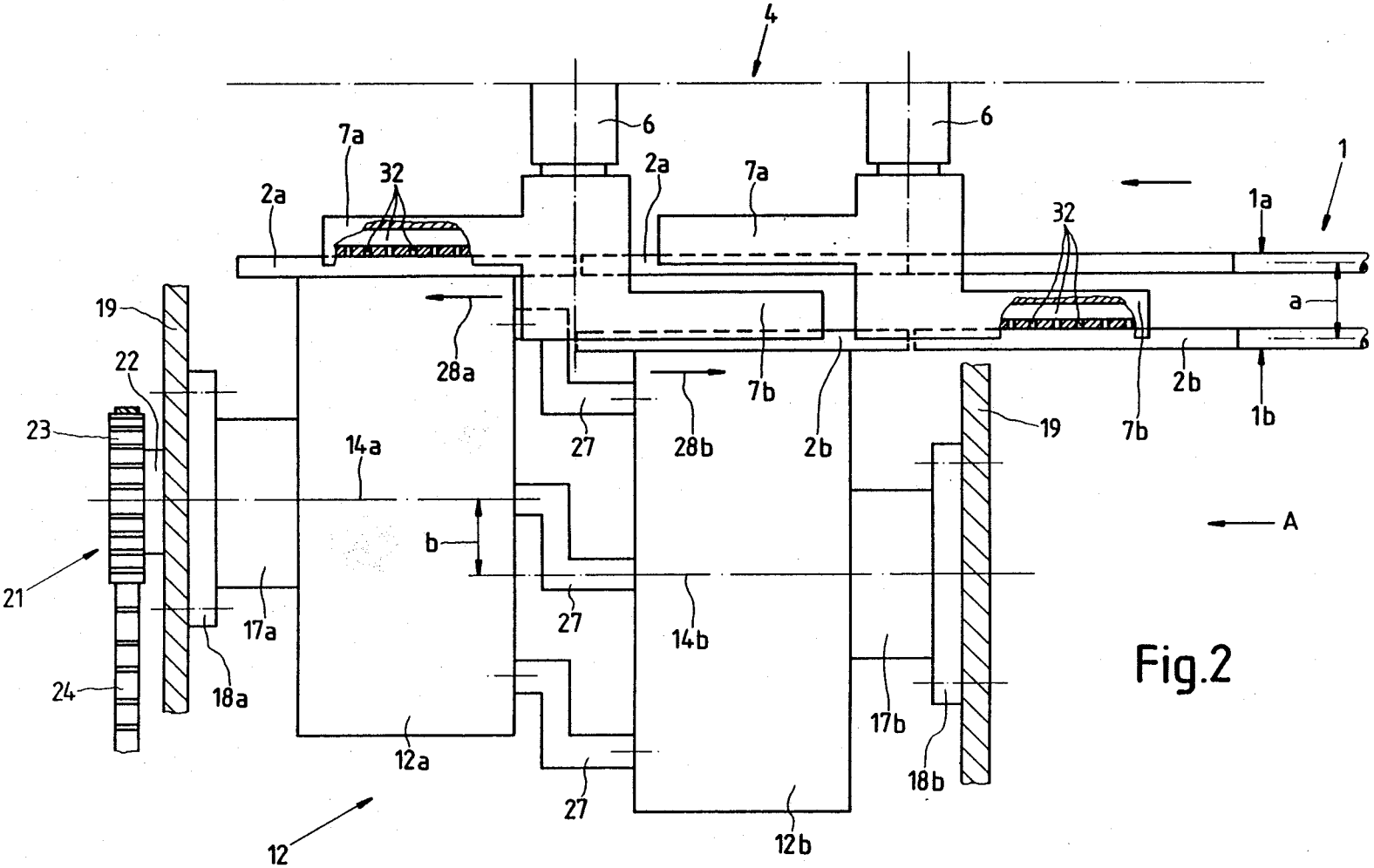
FIG. 2 is an enlarged plan view of the first and second conveyor means and of the means for supplying two files of articles to the removing means of the first conveyor means, with certain elements partly broken away.
Figure 3:
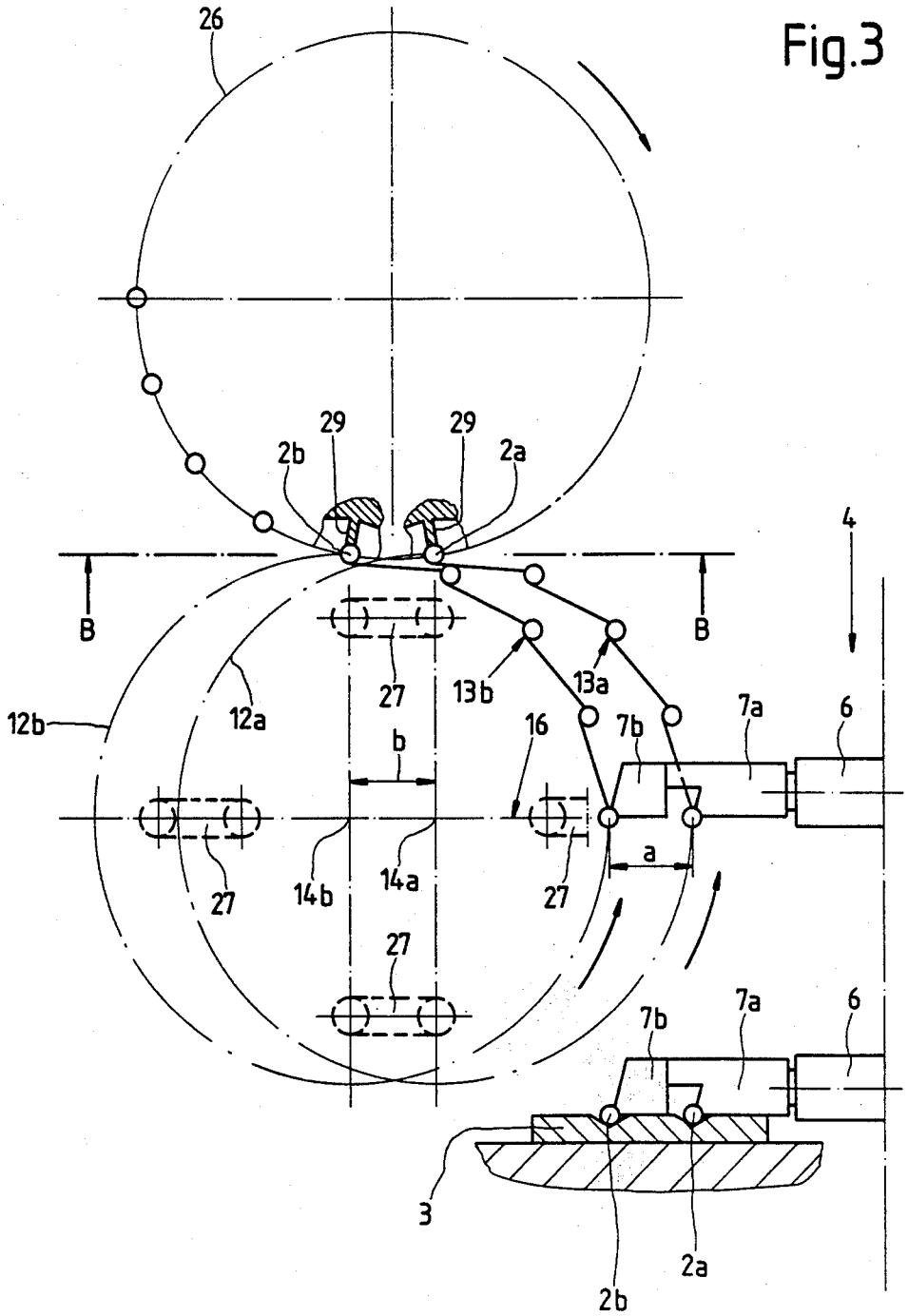
FIG. 3 is a view as seen in the direction of arrow A in FIG. 2, the additional conveyor means being indicated by a phantom-line circle.

The apparatus which is shown in FIGS. 1, 2 and 3 comprises means for supplying two parallel files of rod-shaped articles 2*a* and 2*b* in a horizontal plane and along two parallel paths defined by the grooves 3*a* and 3*b* of an elongated guide rail 3. The machine which turns out two continuous rods can be designed in the same way as disclosed in the aforementioned patent to Grupe. The disclosure of this patent is incorporated herein by reference. One manner in which several rods can be severed to yield several discrete files of plain cigarettes of unit length or multiple unit length is disclosed in commonly owned U.S. Pat. No. 4,377,098 granted Mar. 22, 1983 to Bardenhagen et al. for "apparatus for simultaneous severing of plural moving parallel rods". The cigarettes 2*a* in the groove 3*a* form a continuous file wherein the neighboring cigarettes are disposed end to end, and the same applies for the cigarettes 2*b* which advance in the groove 3*b*. FIG. 2 shows a twin rod 1 which is composed of two parallel files 1*a*, 1*b* of discrete plain cigarettes 2*a*, 2*b*.

The apparatus comprises a first conveyor 4 which includes a plurality of article removing means 6 in the form of suitably configurated crank arms arranged to orbit about a horizontal axis 11 along an endless path which is indicated by a phantom-line circle 8. Each removing means or arm 6 is further rotatable about its own axis 9 so that its orientation remains unchanged. Each arm 6 carries two axially staggered article conveying elements *7a, 7b* each of which has a flute for reception of a discrete cigarette *2a, 2b*. respectively. The mutual positions of conveying elements *7a, 7b* on each of the arms 6 are such that the cigarettes *2a, 2b* which are carried thereby are staggered axially relative to each other by the length of a cigarette *2a* or *2b*. The length of the cigarettes *2a* matches the length of the cigarettes *2b*. The conveyor 4 includes two planetary transmissions which effect the movements of arms 6 along the endless path 8 and about the respective axes 9 in such a way that the inclination of the removing elements *7a, 7b* remains unchanged, i.e., that the removing elements remain parallel to the plane of the grooves *3a, 3b* in the upper side of the guide rail 3. This ensures that the cigarettes *2a, 2b* which are carried by the conveying elements *7a, 7b* are invariably ready for transfer onto a second conveyor 12 having two rotary drum-shaped conveyors *12a, 12b* which are indicated in FIG. 1 by phantom-line circles. The conveyors 12, *12b* are rotatable about parallel horizontal axes *14a, 14b* which extend at right angles to the axis 11 of the conveyor 4. The conveying elements *7a, 7b* of each arm 6 travel along an elliptical path. Conveyors of such type are disclosed in considerable detail in commonly owned U.S. Pat. No. 4,051,947 granted Oct. 4, 1977 to Schumacher et al. for "Transfer apparatus for cigarettes". The disclosure of this patent is incorporated herein by reference. Other types of transfer apparatus for cigarettes and the like are disclosed in applicant's commonly owned U.S. Pat. Nos. 4,408,621 and 4,465,083.

The flutes of the conveying elements *7a, 7b* on each arm 6 are parallel to each other and their mutual spacing matches the mutual spacing a (FIG. 2) of the two files *1a, 1b* of plain cigarettes *2a, 2b* in the grooves *3a, 3b* of the guide rail 3. The arrangement is such that the conveying elements *7a* of successive arms remove successive cigarettes *2a* from the groove *3a* and the conveying elements *7b* of successive arms 6 remove successive cigarettes *2b* from the groove *3b* of the guide rail 3 when the apparatus is in use and the arms 6 orbit along the path 8 while simultaneously rotating about the respective axes 9. FIG. 2 shows that the conveying element *7a* of an arm 6 at the transfer station between the guide rail 3 and the conveyor 4 removes a cigarette *2a* from the file *1a* ahead of the locus of removal of a cigarette *2b* by the associated conveying element *7b* from the file *1b*. As mentioned above, the extent to which the cigarettes *2a, 2b* on the conveying element *7a, 7b* of an arm 6 are staggered relative to each other equals the length of a cigarette *2a* or *2b*. The conveying elements *7a, 7b* of successive arms 6 approach the files *1a, 1b* from above and thereupon transport the accepted pairs of cigarettes *2a, 2b* in a clockwise direction along the endless path 8 while the respective arms turn about the corresponding axes 9 so that the orientation of the cigarettes *2a, 2b* which travel with the arms 6 remains unchanged.

The rotary drum-shaped conveyors *12a, 12b* of the second conveyor 12 are designed to transport the cigarettes *2a, 2b* at right angles to the axes of such cigarettes. In other words, the direction of travel of cigarettes *2a* and *2b* changes by 90 degrees when the conveying elements *7a, 7b* reach the transfer station between the conveyors 4 and 12. This can be readily seen in FIGS. 2 and 3. The diameter of the drum-shaped conveyor *12a* matches or closely approximates the diameter of the drum-shaped conveyor *12b*, and the mutual spacing of the axes *14a, 14b* of the drum-shaped conveyors equals b which, in turn, equals the mutual spacing of the axes of flutes in the conveying elements *7a, 7b* of an arm 6. The peripheries of the drum-shaped conveyors *12a, 12b* are provided with equidistant transporting members in the form of flutes *13a, 13b*. The mutual spacing of flutes *13a* at the periphery of the conveyor *12a* equals or approximates the mutual spacing of flutes *13b* on the conveyor *12b*. The axes *14a, 14b* of the conveyors *12a, 12b* are disposed in a common horizontal plane 16 which is the plane of the flutes of conveying elements *7a, 7b* on the arms 6 at the transfer station between the conveyors 4 and 12. As mentioned above, the distance a equals or closely approximates the distance b. In other words, the mutual spacing of axes *14a, 14b* equals the mutual spacing of axes of the articles *2a, 2b* in the conveying elements *7a, 7b* of an arm 6 and the mutual spacing of axes of the two files *1a, 1b* of cigarettes *2a, 2b* in the grooves *3a, 3b* of the guide rail 3. Staggering of conveying elements *7a, 7b* on each of the arms 6 and staggering of the axes of the conveyors *12a, 12b* render it possible to transport a cigarette *2a* from a conveying element *7a* into a flute *13a* of the drum-shaped conveyor *12a* while the conveying element *7b* of the same arm 6 transfers a cigarette *2b* into a flute *13b* of the drum-shaped conveyor *12b*.

The shafts (not shown) of the conveyors *12a, 12b* are respectively rotatable in bearing sleeves *17a, 17b* (see FIG. 2) having flanges *18a, 18b* which are mounted if the frame 19 of the improved apparatus. The drive means for rotating the drum-shaped conveyor *12a* of the second conveyor 12 is shown at 21 in the lefthand portion of FIG. 2. Such drive means comprises a pinion 23 secured to a stub 22 of the shaft which is journalled in the bearing sleeve *17a*, and the pinion 23 mates with a gear or with and is driven by the teeth of an internally toothed belt 24.

In order to ensure that the drum-shaped conveyors *12a, 12b* of the second conveyor 12 will be driven in synchronism, as well as that the flutes *13a*, 13B of the drum-shaped conveyors can deliver cigarettes *2a, 2b* into the flutes 29 of an additional drum-shaped conveyor 26 (see FIGS. 3 and 4), it is necessary to properly synchronize the rotary movements of the drum-shaped conveyor *12a* with those of the drum-shaped conveyor *12b*. In the illustrated apparatus, such synchronization is achieved by the provision of torque transmitting lever or link arrangements 27 which are schematically shown in the central portion of FIG. 2. Levers or links which can be used in the improved apparatus to kinematically connect the drum-shaped conveyors *12a* and *12b* to each other can be of the type disclosed in commonly owned U.S. Pat. No. 3,521,513 granted July 21, 1970 to Gömann et al. for "Transfer apparatus for rod-shaped articles". The disclosure of this patent is incorporated herein by reference.

In order to avoid collision between the cigarettes *2a* which are transferred into the flutes *13a* and the cigarettes *2b* which are transferred into the flutes *13b*, it is desirable to provide the flutes *13a, 13b* with means for moving the respective cigarettes *2a, 2b* axially and away from each other. Axial shifting of cigarettes *2a* in the flutes *13a* away from the cigarettes *2b* in the flutes *13b* is not always necessary but is preferred in many instances in order to reliably prevent any collision of such articles during transport by the drum-shaped conveyors *12a, 12b* toward the station where such cigarettes are transferred into the flutes 29 of the additional conveyor 26. The directions in which the cigarettes 2a, 2b are movable axially and away from each other are indicated in FIG. 2 by arrows 28a, 28b. Shifting of cigarettes in the flutes 13a, 13b away from each other can be effected by employing movable flutes which are reciprocable in the axial direction of the respective drum-shaped conveyors 12a, 12b. For example, portions of the flutes 13a, 13b can be shifted in the directions of axes 14a, 14b by suitable cams along which the followers of movable flute portions travel while the drum-shaped conveyors 12a, 12b rotate about the axes 14a, 14b, respectively. Alternatively, it is possible to place stationary rails adjacent the path of one end portion of each cigarette 2a on the drum-shaped conveyor 12a and adjacent one end of each cigarette 2b on the drum-shaped conveyor 12b so that the cigarettes are shifted axially by sliding with their ends along the respective stationary rails. Such mode of shifting rod-shaped articles of the tobacco processing industry is well known in the art. Reference may be had to numerous United States and foreign patents of the assignee, for example, to commonly owned U.S. Pat. No. 4,538,629 granted Sept. 3, 1985 to Grasse et al. for "Method and apparatus for the production and manipulation of plain cigarettes and the like". The disclosure of this patent is incorporated herein by reference.

Figure 4:
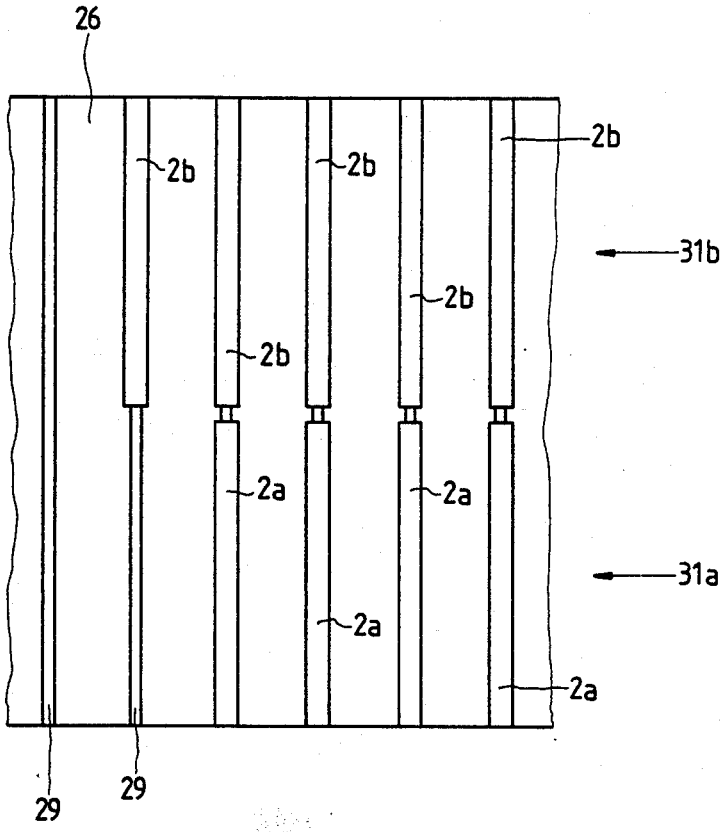
FIG. 4 is an enlarged fragmentary developed view of the additional conveyor means as seen in the direction of arrows from the line B—B of FIG. 3.

The additional conveyor 26 resembles or constitutes a drum which is driven in synchronism with the drum-shaped conveyors 12a, 12b of the second conveyor 12 and has elongated flutes 29 each of which is capable of accommodating a cigarette 2a simultaneously with a cigarette 2b. The flutes 29 are machined or otherwise formed in the periphery of the conveyor 26 and are parallel to the flutes 13a, 13b of the drum-shaped conveyors 12a, 12b. This can be readily seen in FIG. 3. The purpose of the conveyor 26 is to eliminate the staggering of cigarettes 2a and 2b so that each cigarette 2a is coaxial with a cigarette 2b as soon as such cigarettes are received in a common flute 29 of the conveyor 26. As can be seen in FIG. 4, the length of each flute 29 suffices to ensure that the conveyor 26 can transport two parallel rows 31a, 31b of cigarettes 2a, 2b side by side and in a clockwise direction, as seen in FIG. 3. The conveyor 26 can form part of a filter tipping machine wherein pairs of plain cigarettes 2a, 2b are united with filter mouthpieces of double unit length by suitable uniting bands to form filter cigarettes of double unit length. Each such filter cigarette of double unit length is then severed midway between its ends to yield two coaxial filter cigarettes of unit length. In order to place a filter mouthpiece of double unit length between each pair of coaxial cigarettes 2a, 2b, it is normally necessary to shift one of the aligned cigarettes 2a, 2b or both such cigarettes axially and away from the other cigarette or cigarettes so as to ensure that a filter mouthpiece of double unit length can fit between them prior to the application of a uniting band which is coated with adhesive and serves to surround the filter mouthpiece of double unit length as well as the adjacent inner end portions of the respective plain cigarettes 2a and 2b. Reference may be had, for example, to commonly owned U.S. Pat. No. 4,484,591 granted Nov. 27, 1984 to Günter Wahle for "Method of testing and classifying cigarettes or the like".

The central portion of FIG. 3 shows that a flute 29 receives a cigarette 2a from the oncoming flute 13a of the drum-shaped conveyor 12a while another flute 29 receives a cigarette 2b from the oncoming flute 13b of the drum-shaped conveyor 12b when such flutes reach a plane corresponding to that which is indicated in FIG. 3 by a heavy phantom line (B—B) parallel to the line indicating the plane 16. Thus, the arrangement is such that each flute 29 first receives a cigarette 2b from the drum-shaped conveyor 12b and thereupon a cigarette 2a from the drum-shaped conveyor 12a. After the drum-shaped conveyors 12a, 12b and 26 advance by a distance corresponding to the mutual spacing of two flutes 13a, 13b or 29, the flute 29 which has received a cigarette 2b receives a cigarette 2a so that each flute 29 ultimately carries two coaxial cigarettes 2a, 2b as shown in the right-hand portion of FIG. 4.

When the apparatus is started, the flute 29 which approaches the transfer station between the conveyors 12 and 26 receives a single cigarette 2b so that such flute is only partially filled with rod-shaped articles. Therefore, the apparatus preferably comprises a nozzle which is connectable to a source of compressed air and is adjacent the path of movement of flutes 29 at the periphery of the conveyor 26 so as to expel the single cigarette 2b from the foremost flute 29 in order to avoid the making of a defective filter cigarette. The expelling means is not specifically shown in the drawing because such types of means are well known in the art of making filter cigarettes and other rod-shaped articles of the tobacco processing industry.

FIG. 2 shows that the conveying elements 7a, 7b of the arms 6 are formed with suction ports 32 and with suitable channels which are connected to a suction generating device (not shown) during certain stages of orbital movement of each arm 6, namely during those stages when the conveying elements 7a, 7b respectively carry cigarettes 2a, 2b from the guide rail 3 to the drum-shaped conveyors 12a, 12b of the second conveyor 12. Similar suction ports are also provided in the flutes 13a, 13b and 29 in order to reliably hold the cigarettes 2a, 2b during travel with the respective conveyors. The manner in which suction ports in the flutes of means for conveying rod-shaped articles of the tobacco processing industry are connectable with one or more suction generation devices during certain stages of their movement along the corresponding path or paths is well known from the art of making cigarettes and the like.

The improved apparatus can be modified in a number of ways without departing from the spirit of the invention. For example, each of the drum-shaped conveyors 12a, 12b can be replaced with a chain or belt conveyor and/or driven by a separate driving unit. The arrangement which is shown in FIG. 2 is preferred at this time because it invariably ensures accurate synchronization of angular movements of the drum-shaped conveyor 12b with those of the drum-shaped conveyor 12a.

An important advantage of the improved apparatus is that it renders it possible to change the direction of transport of two files of articles which move axially in a small area and with a high degree of reliability. This reduces the number of rejects which are turned out by the processing machine, such as a filter tipping machine.

Another important advantage of the improved apparatus is that it can accept cigarettes or other rod-shaped articles of the tobacco processing industry from two files of articles which can be located at any practical distance from each other. All that is necessary is to conform the mutual spacing of the conveying element 7a, 7b and the mutual spacing of the axes 14a, 14b of the drum-shaped conveyors 12a, 12b to the mutual spacing of the two files 1*a*, 1*b* of rod-shaped articles 2*a*, 2*b* in the grooves 3*a*, 3*b* of the guide rail 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for transporting rod-shaped articles of the tobacco processing industry, comprising means for supplying a plurality of parallel files of rod-shaped articles wherein the articles of each file are coaxial with each other and move axially; first conveyor means having a plurality of successive means for simultaneously removing groups of articles from said supplying means, one article from each file, and for moving the articles of the groups substantially axially along a first path; and second conveyor means having a plurality of means for simultaneously accepting groups of articles from successive removing means of said first conveyor means and for moving the articles of the accepted groups substantially at right angles to the axes of the respective articles.

2. The apparatus of claim 1, wherein said supplying means includes means for supplying two files of articles so that each of said groups consists of two articles.

3. The apparatus of claim 2, wherein said supplying means includes means for maintaining the articles of said two files in a common plane.

4. The apparatus of claim 3, wherein said plane is a substantially horizontal plane.

5. The apparatus of claim 2, wherein said first conveyor means comprises means for circulating said removing means along an endless path, each of said removing means having two article conveying elements and the mutual positions of conveying elements of each of said removing means corresponding to that of the two files of articles in said supplying means.

6. The apparatus of claim 5, wherein the conveying elements of each of said removing means are parallel to each other and are spaced apart from each other by a first distance, the articles in said two files being spaced apart from each other by a second distance which at least approximates said first distance.

7. The apparatus of claim 5, wherein the article conveying elements of each of said removing means are staggered relative to each other in the axial direction of the articles therein.

8. The apparatus of claim 7, wherein the conveying elements of each removing means are staggered relative to each other to an extent such that the articles which are conveyed thereby are staggered by the length of an article.

9. The apparatus of claim 5, wherein said first conveyor means further comprises means for maintaining said removing means in a single predetermined orientation so that the articles which are carried by said conveying elements are invariably ready for transfer onto said second conveyor means.

10. The apparatus of claim 2, wherein said second conveyor means comprises two endless rotary conveyors each having an annulus of article transporting members.

11. The apparatus of claim 10, wherein each of said rotary conveyors includes a drum having a peripheral surface and said transporting members include axially parallel flutes provided in the peripheral surfaces of said drums.

12. The apparatus of claim 10, wherein said rotary conveyors have parallel axes of rotation.

13. The apparatus of claim 10, wherein said annuli have identical diameters and the mutual spacing of neighboring transporting members of each of said annuli is the same.

14. The apparatus of claim 10, wherein said rotary conveyors have spaced-apart parallel axes of rotation and said first conveyor means comprises means for circulating said removing means along an endless path, each of said removing means having two spaced apart parallel article conveying elements and the mutual positions of conveying elements of each of said removing means corresponding to that of the two files of articles in said supplying means, the distance between the axes of said rotary conveyors being equal to or closely approximating the distance of the conveying elements of each of said removing means from one another.

15. The apparatus of claim 10, wherein said rotary conveyors have parallel axes of rotation which are disposed in a predetermined plane, said removing means being arranged to deliver pairs of articles to the transporting means of said rotary conveyors in said predetermined plane.

16. The apparatus of claim 10, wherein said second conveyor means further comprises means for rotating said rotary conveyors about discrete parallel axes in synchronism with each other.

17. The apparatus of claim 16, wherein said rotating means includes a drive for one of said rotary conveyors.

18. The apparatus of claim 17, further comprising means for transmitting torque from said one rotary conveyor to the other of said rotary conveyors.

19. The apparatus of claim 18, wherein said torque transmitting means comprises at least one linkage.

20. The apparatus of claim 10, wherein said first conveyor means includes means for circulating said removing means along an endless path about a predetermined axis, said rotary conveyors being rotatable about parallel axes extending at least substantially at right angles to said predetermined axis.

21. The apparatus of claim 10, wherein each of said transporting members includes means for effecting or facilitating axial movements of the article therein so as to avoid collision of articles which are transported by the transporting members of one of said annuli with articles which are transported by transporting members of the other of said annuli.

22. The apparatus of claim 10, further comprising additional conveyor means having means for accepting articles from the transporting members of said rotary conveyors.

23. The apparatus of claim 22, wherein said accepting means includes flutes each having a length such that it can receive an article from each of said rotary conveyors.

24. The apparatus of claim 23, wherein the transporting members of said rotary conveyors are arranged to substantially simultaneously deliver discrete articles into consecutive flutes of said additional conveyor means.

25. The apparatus of claim 23, wherein each of said flutes is arranged to receive first an article from a transporting member of one of said rotary conveyors and thereupon an article from a transporting member of the other of said rotary conveyors.

26. The apparatus of claim 22, wherein said second and additional conveyor means include means for moving the transporting members and the accepting means in synchronism so that said additional conveyor means receives and conveys two rows of parallel articles which move at right angles to their respective axes.

* * * * *